United States Patent [19]

Frymoyer

[11] 3,941,365

[45] Mar. 2, 1976

[54] SUPPORT AND MANIPULATION TABLE FOR SPINAL EXAMINATION AND EXPERIMENTATION

[76] Inventor: Willard W. Frymoyer, 43 Granite St., Foxborough, Mass. 02035

[22] Filed: Mar. 29, 1974

[21] Appl. No.: 456,046

[52] U.S. Cl. ..... 269/325; 269/328

[51] Int. Cl.[2] ..... A61G 13/00

[58] Field of Search ..... 269/322, 323, 324, 325, 269/326, 328

[56] References Cited

UNITED STATES PATENTS

| | | | |
|---|---|---|---|
| 2,494,746 | 1/1950 | Colston | 269/325 |
| 2,897,029 | 7/1959 | Maisel | 269/323 |
| 3,353,820 | 11/1967 | Langren | 269/328 |
| 3,652,851 | 3/1972 | Zoalberg | 269/322 |
| 3,778,049 | 12/1973 | Viamonte | 269/323 |
| 3,799,534 | 3/1974 | Coles | 269/322 |

*Primary Examiner*—Roy Lake
*Assistant Examiner*—Mark S. Bicks
*Attorney, Agent, or Firm*—Norman E. Brunell

[57] ABSTRACT

A table is shown suitable for use in supporting, manipulating and positioning human bodies or cadavers during examination, diagnosis and experimentation involving the spine. A pelvic support and a thoracic support are separately slidably mounted on a frame base table. Each support is provided with positioning rods which may be placed in predrilled holes in the pelvic and thoracic regions respectively. The positioning rods are pivoted for rotation so that the cadaver's spine may be controllably and adjustably positioned to simulate forward bending motion of the spine. The thoracic support is pivoted along two axes to provide lateral bending and rotation adjustments. Sensitive plates are positioned below and to the side of the cadaver for sequential radiographic analysis of the spinal region between the positioning rods during various postures controlled by adjustment of the rods and supports. Suitable indexing and locking mechanisms are provided so that a series of sequential positions may be examined.

10 Claims, 9 Drawing Figures

SUPPORT AND MANIPULATION TABLE FOR SPINAL EXAMINATION AND EXPERIMENTATION

BACKGROUND OF THE INVENTION

1. Field of the Invention

This invention relates to a support table for use in examination, diagnosis and experimentation with the spinal regions of human bodies and the like. The invention further relates to such a table that may be used to manipulate the body during examination in order to simulate natural spinal motions. In particular, the instant invention relates to a table suitable for use in the examination of human cadavers to obtain sequential radiographs of portions of the spine in both relaxed and manipulated positions.

2. Description of the Prior Art

Conventional supporting structures used in radiographic examination provide a flat surface, such as a table top, upon which the subject may be placed. Certain of the art devices provided for motion of the flat surface about its own axes to place the body in a suitable position with respect to fixed radiographic equipment. None of the art devices provide means for positioning part of the body with respect to other parts except for simple restraints to prevent any motion. The conventional solution to the present problem of manipulating body posture would be to place objects, such as wooden blocks, under part of the body. This technique is obviously unsuitable for obtaining accurately repeatable radiographs. A major limitation of conventional equipment and practices is related to the distortion of the relationship between the discs and vertebra of the spine during manipulation and positioning. During life the spine is deflected by the combination of forces resulting from muscular tension and external forces such as gravity acting on the various body members. These forces are applied to the spine at many different points and from many different and varying angles. It is highly desirable to examine the spine in positions correlating closely to those occuring during life in order to collect the most relevant information. It is therefore a distinct limitation on the accuracy and usefulness of experimental and dignostic data to have obtained it during experimentation using equipment that does not closely simulate these various forces nor allow the spine to stabilize, i.e. to choose the most natural relationships for its component parts in a manipulated position. Conventional practice, where available, applies a rigid force, often from an arbitrary direction, to the body at points chosen for convenience resulting in a distortion of the relationship between the spinal components from that which may occur during life.

SUMMARY OF THE INVENTION

In order to avoid the difficulties of conventional apparatus and to provide a support table suitable for supporting the subject in a natural or manipulated position wherein the relationship between the discs and vertebra is caused to be close to that occuring during life, the instant invention provides a complete table unit as follows. A frame base is provided upon which is mounted a pair of tracks. Individually slidable upon these tracks are both a pelvic and a thoracic support. An interconnect rod is provided so that, after the manipulated subject has been stabilized in a desired posture, the supports may be firmly locked together to prevent any further motion of the spine. Low friction bearings assemblies are provided which allow the subject to stabilize with minimal distortion effects from mechanical friction.

A locking and indexing device is provided to control motion of the support pair along the tracks. This device may be used to repeatably position the combination of supports along the base table in order to obtain a series of radiographs with the subject displaced a controlled amount along the axis of the spine.

The pelvic support is provided with a lifting plate having a controllable supply of air so that the subject may be placed upon the plate and then easily positioned with respect to the table while partially supported by the air pressure. Once the subject is properly aligned the air supply may be removed. A pelvic locator is provided which may be firmly affixed to the pelvic region of a cadaver by means of screws to locate the cadaver with respect to suitable locators affixed to the pelvic support. A drill guide is removably mounted on the pelvic support so that mounting holes may be precisely drilled through the cadaver's pelvic regions parallel to the table and perpendicular to the longitudinal axis of the spine. Positioning rods may then be inserted into these holes and secured to an assembly rotatably mounted on the support. A handle and locking mechanism is provided so that the rods may be rotated and locked into position. This arrangement provides a means for causing a controllable and repeatable bending motion of the spine. Low friction bearings are provided in the rotation mechanism to allow the spine to stabilize and assume a relatively natural configuration once rotated a certain amount.

The thoracic support is also provided with a lifting plate and positioning rod assembly similar to the above described devices and used in the same manner. A spinal locator is provided which may be affixed to a preselected vertebra so that the upper portion of the cadaver may be accurately positioned with the respect to the thoracic support by means of a corresponding locator affixed thereto.

The thoracic lifting plate is positioned on a thoracic cradle plate. The cradle plate is pivotably mounted to a main plate so that the spine may be rotated about its longitudinal axis. The axis of rotation is arranged, by the use of a phantom pivot point, to coincide with the effective axis of rotation of the spine to insure naturalness of the motion. The cradle plate is mounted for motion on a base plate so that the spine may be rotated with respect to the pelvic region to provide lateral bending of the spine. The pivot point for this lateral bending rotation may be adjusted along the axis of the spine to compensate for the differences in the height of cadavers used. Locking and indexing means are provided in the thoracic support to control the rotation of the cradle plate. Low friction bearings are also provided at these points to allow the spine to more freely and stabilize before the locking means are activated.

Radiographic sources may be positioned with respect to the base table so that a pair of radiographs of the spine may be simultaneously exposed at right angles to each other.

DETAILED DESCRIPTION OF A PREFERRED EMBODIMENT

A detailed description of a preferred embodiment of the instant invention is given herein showing the best mode of construction presently known. Because the instant invention is a device in the manner of experimental apparatus suitable for many specific experimental purposes in the related fields of art, it is necessary to describe the invention in the detailed terms of a configuration optimized for a particular type of experiment. It must be noted that the specific configuration shown herein is therefore not intended to limit the scope of this invention but rather provide a teaching of the fundamental concepts so that the invention may be applied to the specific requirements of other experiments.

In particular, therefore, the exact placement of the various threaded rods, screws, and other devices intended to be attached in some manner to a cadaver are for illustrative purposes and may of course be rearranged for use in another type of experiment without deviating from the spirit or scope of the instant invention. In addition it would certainly be within the ability of a man having ordinary skill in the mechanical arts to add simple mechanical refinements of specific features of the preferred embodiment shown herein to increase ease of use or efficiency. Such refinements have not been added to the embodiment shown herein in order to preserve the flexibility of the present arrangement.

The preferred embodiment described herein is intended for use in a series of experiments the object of which is the gathering of sequential radiographs, in two perpendicular planes, of the lower spine of a human cadaver taken in both relaxed and manipulated positions. One requirement is that the relative positions of the vertebrae and discs of interest approximate the positions naturally occuring in a living being under conditions of forward and lateral bending, and axial rotation. A further requirement is that the relative positions of the radiographic source, the spine and the radiographic plates are maintained constant. In addition radiographs were to be made both in the horizontal and vertical planes at the same instant in time under the same controlled restrictions. Further, in order to study and correct for the point source distortion inherent in this type of Xray experimentation, it may be desirable to take a sequence of radiographs of a spine, each set of radiographs displaced by a predetermined distance.

Figure 1:
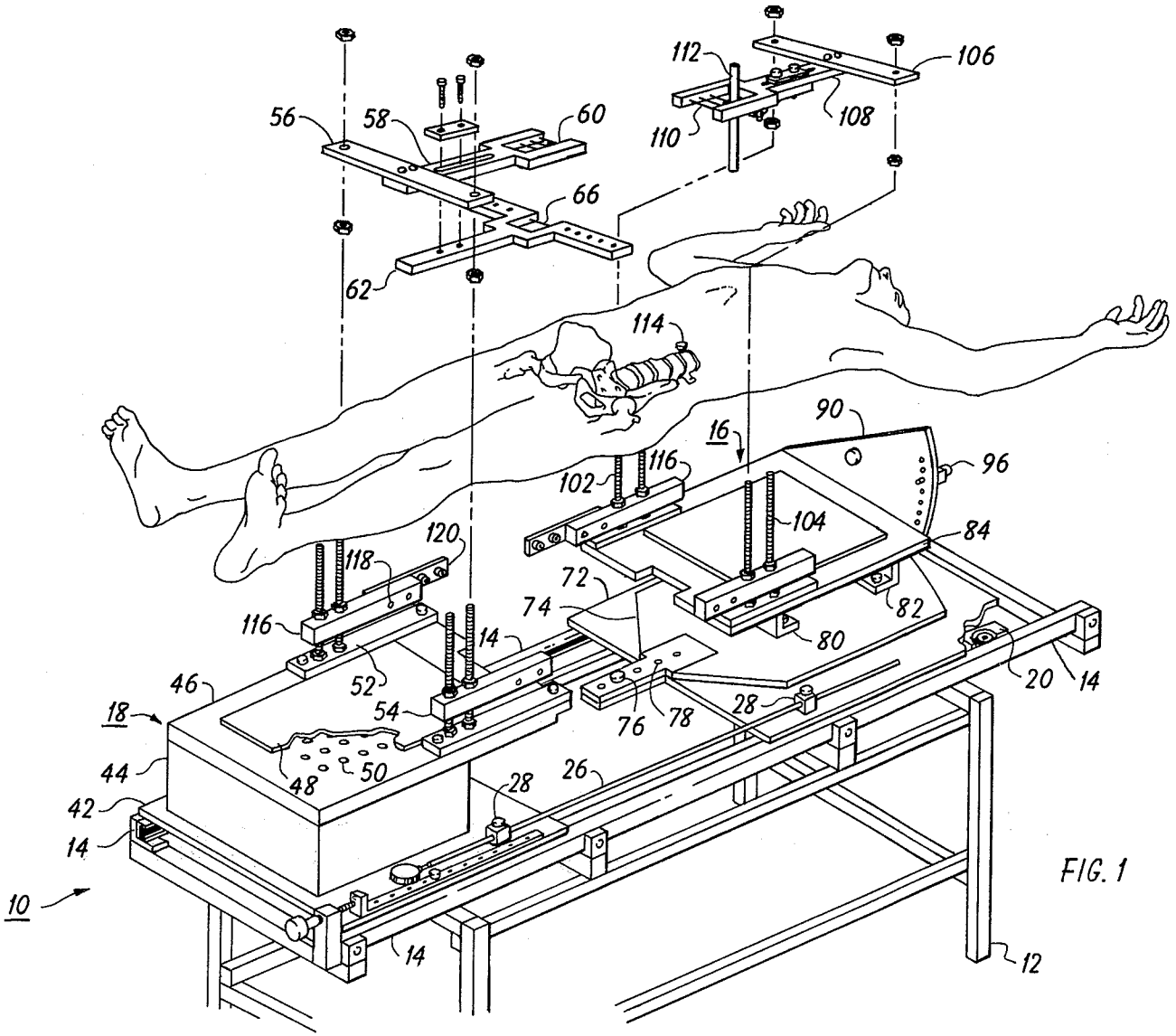
FIG. 1 is an isometric view of the basic table of the instant invention with the radiographic equipment removed for clarity and a cadaver, together with the locator mechanisms, shown in an exploded fashion vertically above the table.

FIG. 1 is a partial view of the device of the instant invention shown without the radiographic equipment for ease of explanation. The upper portion of the device is shown in an explosed view fashion together with a cadaver for ease in explaining the relative positioning of parts of the device to the cadaver. The instant invention will be described basically with reference to FIG. 1 while the other figures serve to explain and clarify details of construction.

The table 10 of the instant invention is supported by the frame base table 12 which may conveniently be constructed from drawn tubing or other inexpensive standard construction materials. Mounted along the upper surface of the table are a pair of runway tracks 14. These tracks serve to support and align all equipment mounted on them. The tracks may be conveniently constructed of square tubing similar to that used in the construction of the table. It is desirable to utilize tubing having a cross sectional area in the shape of the letter C so that perpendicularly positioned bearings may be utilized to provide increased support and alignment accuracy as will be described in greater detail with reference to FIG. 2.

Figure 2B:
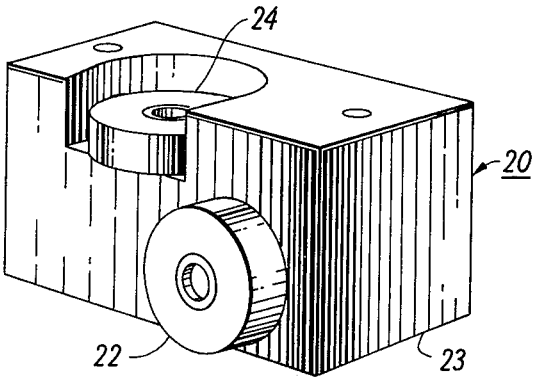
FIGS. 2A and 2B are views of one of the eight bearing assemblies used to support and align the pelvic and thoracic supports on the runway tracks of the table.
Figure 2A:
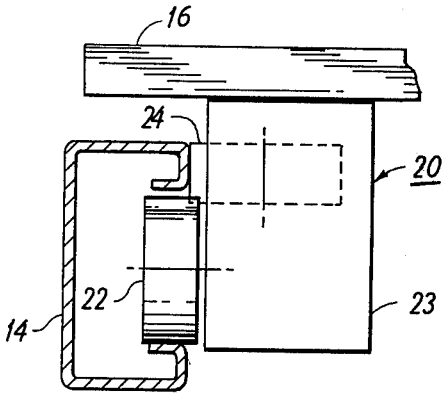

Mounted upon the tracks are a thoracic support 16 and a pelvic support 18. Each of these supports is mounted upon the tracks by a suitable number of bearing assemblies 20 as shown in FIGS. 2A and 2B. With reference now to FIG. 2A, the cross section of the tubing used in constructing runway tracks may be clearly seen. Mounted within the opening of the track 14, as part of each bearing assembly, is a vertical support bearing 22 and a horizontal support bearing 24 mounted for rotation on body 23. The vertical bearing 22 serves to support the weight of the superstructure (which is shown in FIG. 2A as a portion of the thoracic support 16). In addition the horizontal bearing 24 serves to provide an aligning force maintaining the superstructure within and on the tracks. For this purpose the bearing assemblies 20 are mounted so that the tracks apply a compressive force against them. FIG. 2B shows the staggered mounting of the horizontal and vertical bearings on body 23.

These bearing assemblies, normally one in each corner of both the thoracic support 16 and the pelvic support 18, allow these supports to slide freely and separately along the tracks while maintaining alignment with each other. Relative motion between these supports is required to allow positioning of the supports for various cadaver sizes and configurations and to allow the cadaver to stabilize itself in any particular manipulated position.

It is necessary to allow these supports to have the freedom to move with respect to each other, along the longitudinal axis of the spine, to prevent distortion of the relationship between the discs and vertebrae of the spine during examination. In particular, the supports are shown in FIG. 1 moved further apart than necessary for the cadaver shown in order to clearly show the details of thoracic support 16. An interconnect rod 26 is connected to each support by means of a locking device 28. These devices may be adjusted so that the rod may move freely through them thereby allowing the relative positioning of the supports 16 and 18. These locking devices may both be secured to the rod so that the supports are mechanically secured together and move as a unit along the tracks.

Figure 3:
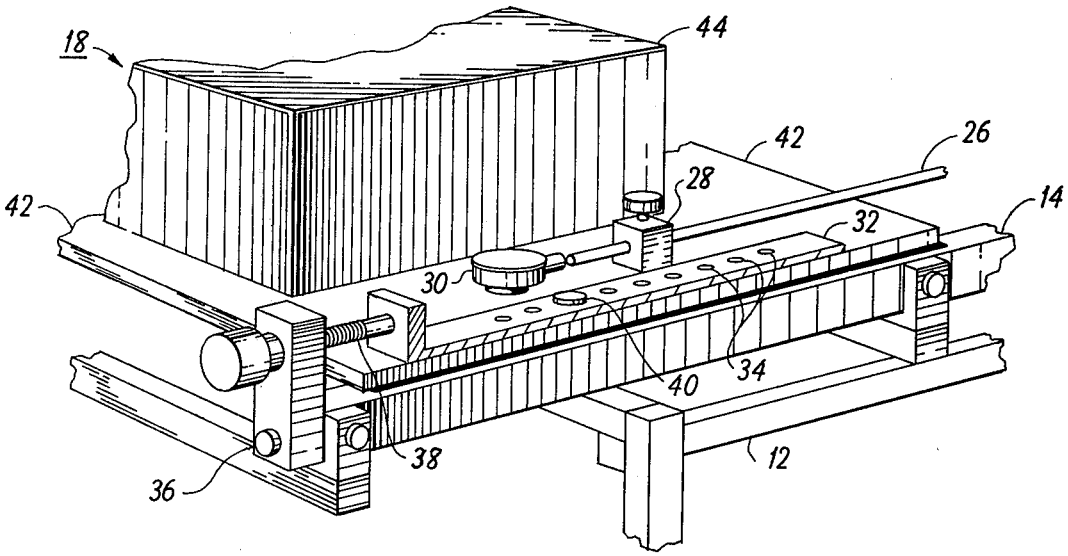
FIG. 3 is an enlarged view of the lower left hand corner of the table, as shown in FIG. 1, detailing the table indexing and locking mechanisms.

As shown in greater detail in FIG. 3, the rod 26 extends across the top of the lower most portion of the pelvic support 18 and through the locking device 28. This locking device may simply be a metal support having a hole through which the rod may pass and a locking screw for preventing motion between the rod and the locking device. At one end of the rod a micrometer position detecting device 30 may be mounted to the pelvic support 18 in order to measure the relative position between the rod and the pelvic support. In this manner very careful and precise measurements and or adjustments of the distance between the pelvic and thoracic supports may be accurately made.

FIG. 3 also shows in detail the indexing mechanism utilized to allow the precise positioning of the locked-together assembly of the pelvic and thoracic support with respect to the runway tracks. That is, after the rod has been utilized to secure the thoracic support with respect to the pelvic support, this entire assembly may still be moved along the tracks. This motion of the entire assembly along the longitudinal axis of the spine allows sequential examination of particular points along the spine without motion of the radiographic or other equipment with respect to the table. Such controlled and indexed motion is accomplished by an indexing strip 32 which is a flat strip of metal resting upon surface of the pelvic support and containing a series of accurately spaced holes 34. The indexing strip 32 is mechanically secured to the runway tracks 14 by a support lock 36 through which is threaded a rod 38. Directly below the indexing strip and aligned with the series of holes is an indexing hole in the upper surface of the pelvic support into which a pin 40 may be positioned. The pin serves to lock the support assemblies with respect to the runway tracks by passing through one of the holes in the indexing strip. It is obvious therefore that if it is desirable to move the entire cadaver support assembly with respect to Xray equipment affixed to the table 12 it is only necessary to temporarily remove the pin and reposition the assembly so that a different hole in the indexing strip is aligned with the hole in the pelvic support. The pin may then be reinserted to secure this new position. In addition the threaded rod 38 which connects the indexing strip to the table is available to further position the series of indexing holes with respect to the table. This fine adjustment by means of the threaded rod 38 allows the index holes to be aligned with any predetermined segment of the spine.

Returning now to FIG. 1 it is appropriate to explain in greater detail the mechanisms that have been designated as the pelvic support 18. The purpose of this support is to support the weight of the lower portion of the cadaver and to provide for mounting of the rod assembly used to secure the pelvis as will be described below. In actual operation of this table the pelvic support 18 would have to be moved along the tracks toward the thoracic support 16 in order to be properly positioned with respect to the cadaver shown. This support consists primarily of a lower tray 42 clearly visible in FIG. 3. The bearing assemblies 20 are provided in each corner of this lower tray to provide connection between it and the runway tracks as described above. In addition the locking device 28, the micrometer 30 and the indexing strip 32 just described are mounted on the lower tray. Also mounted upon the lower tray 42 is a height adjustment block 44. This block serves only to raise the uppermost surface of the pelvic support upon which the cadaver rests to the proper level to match the equivalent surface of the thoracic support. Mounted upon this block is an upper tray 46. Positioned upon upper surface of this upper tray, but not connected thereto, is a lifting plate 48 which is partially cut away to show a series of holes 50 which extend through the upper tray 46. A source of air under pressure, not shown, is connected to these holes so that when air is supplied through these holes the lifting plate is forced away from the upper tray 46. The pelvic region of the cadaver is placed upon the lifting plate 48. To reposition the pelvic portion of the cadaver with respect to the pelvic support it is only necessary to provide the supply of air so that friction between the lifting plate 48 and the upper tray 46 is greatly reduced. Positioning of the cadaver is then extremely easy and removal of the supply of air or even the application of a vacuum effectively locks the pelvic region of the cadaver into position with respect to the pelvic support.

Vertical threaded rod support pairs 52 and 54 are mounted to the sides of the upper tray 46 so that the pelvic region of the cadaver may be positioned there between. Once the cadaver is positioned on the pelvic support, a cross bar 56 may be secured thereto above the cadaver. The cross bar provides a mounting location for a pelvic support locator 68 which extends along the axis of the spine towards the upper portion of the cadaver. The part of the pelvic support locator 58 nearest the head of the cadaver is provided with cross hairs 60.

Before the cadaver is positioned with respect to the pelvic support it is necessary to secure to the pelvic region of the cadaver a pelvic locator Tee 62. The Tee must be secured to the iliac bone of the cadaver by means of screws not shown. These screws affix the pelvic Tee directly to the cadaver to align the Tee with the axis of the spine. This pelvic Tee is provided with a second set of cross hairs 66 so that the pelvic region of the cadaver may be accurately and repeatedly positioned with respect to the pelvic support, and therefore the entire assembly, by aligning the cross hairs 66 with the cross hairs 60 of the pelvic support locater. The positioning of the pelvic locator Tee 62 with respect to the cadaver is more clearly shown herein below with reference to FIG. 8.

It is now convenient to describe the details of the thoracic support 16 before the remaining pieces of the pelvic support are described. These remaining pieces relate to a twisting assembly for rods positioned through the body. This assembly is common to both the pelvic and thoracic supports so that it may be more clearly described herein below.

The thoracic support 16 serves to support the upper portion of the cadaver in the same general manner as the pelvic support 18 serves the lower portion of the cadaver. However, the thoracic support is required to perform two additional functions. Namely, to provide the ability to make lateral bending and axial rotation adjustments.

The foundation of thoracic support 16 is base plate 72 which is analogous to the lower tray 42 of the pelvic support. Plate 72 is provided with four sets of the bearing assemblies 20, described in detail herein above, one in each corner so that the thoracic support may slide along the runway tracks as noted above. A second locking device 28 is mounted on the corner of the plate base 72 nearest the pelvic support 18 to interact with the connecting rod 26 in the manner also described above. Positioned directly upon the plate 72 is a lateral bending plate 74 which is connected thereto only by means of a pin 76. Pin 76 fastens plates 72 and 74 together through one of the series of holes 78 so that the pivot point between the plates may be adjusted to correct for cadavers of varying heights. It may be convenient to provide scale markings and a locking device not shown on the base plate 72 so that the relative position of the lateral bending plate 74 may be noted and secured. Pivoting of the lateral bending plate 74 about the pin 76 provides the lateral bending adjustment.

Figure 4:
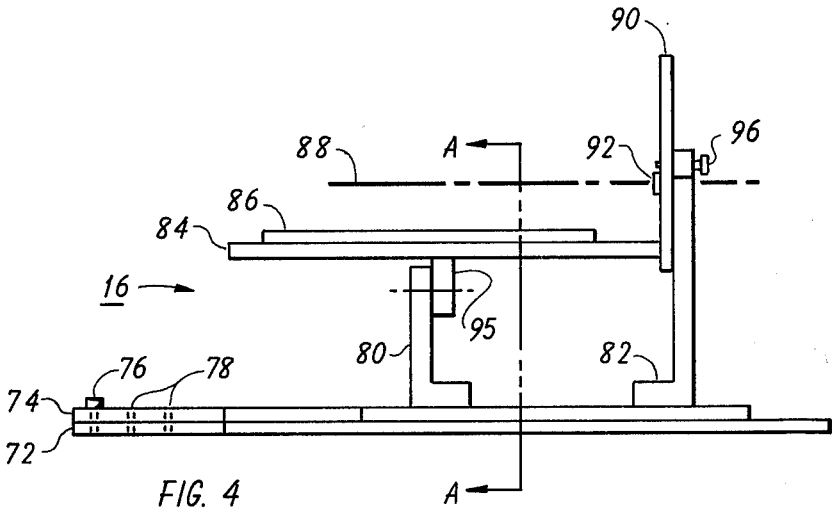
FIG. 4 is a side view of the thoracic support of the instant invention.
Figure 5:
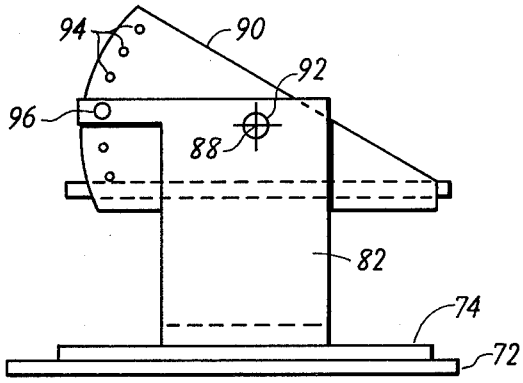
FIG. 5 is a front view of the support shown in FIG. 4.

FIG. 4 is a side view of the thoracic support of FIG. 1 which shows the above-mentioned plates 72 and 74 together with pivot pin 76. Mounted upon the lateral bending plate 74 are two vertical supports 80 and 82 to be described below. These vertical supports provide mounting for a cradle plate 84 upon which rests a lifting plate 86. The lifting plate 86 corresponds to the lifting plate 48 of the pelvic support in that air holes and an air supply not shown are provided so that the lifting plate 86 may operate to facilitate the positioning of the upper portion of the cadaver as described above. The cradle plate 84 is mounted so that it may be rotated about an axis 88 which corresponds to the anatomical rotational axis of the spine of the cadaver. The heights of the vertical supports 80 and 82 are chosen to correspond to the height of the block 44 so that the upper surfaces of the lifting plates 48 and 86 are in the same plane. A sector plate 90 is firmly connected to the cradle plate and pinned to the vertical support 82 by an axle 92. As clearly seen in FIG. 5, the sector plate 90 is provided with a series of holes 94 which together with a pin 96 positioned in a hole in vertical support 82 may be utilized to control and lock the twist of the cradle plate about axis 88. This arrangement provides the axial rotation adjustment.

The cradle plate is required to support approximately one half of the weight of the cadaver and a second pivot point along the axis 88 in addition to axle 92 is therefore abviously required. The axis 88, however, must be vertically above the surface of the lifting plate 86 in order to accurately correspond with the effective axis of the spine. The axle 92 is easily positioned at this vertical level in the sector plate 90 which is beyond the head of the cadaver. The second pivot point must be mounted along the length of the upper point of the cadaver and therefore a phantom pivot point must be used.

Figure 6:
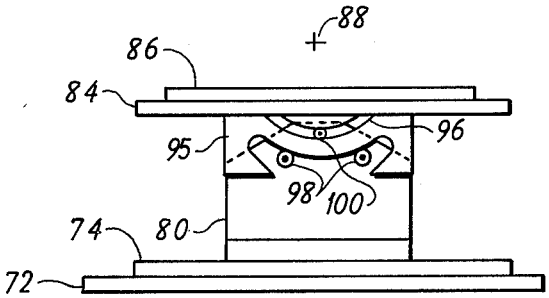
FIG. 6 is a sectional view of the thoracic support of FIG. 4 taken along line AA.

FIG. 6 is a sectional view of the thoracic support taken along lines AA of FIG. 4. In order to provide the phantom pivot point the cradle plate 84 is provided with a support plate 95 bolted thereto. Plate 95 is provided with a semi-circular slot 96 the center of rotation of which is along axis 88. The outside edge of plate 95 is a portion of a circle the center of rotation of which is also axis 88. The vertical support 80 is provided with a pair of bearings 98 which serve to support the lower edge of the plate 95. Similarly the vertical support 80 is provided with bearing 100 which fits within the slot 96. It can be seen therefore that the cradle plate 84 is allowed to pivot about axis 88 and is supported in such pivoting by a pivot point at the axle 92 and a phantom pivot point created by the bearings described immediately above.

It is now convenient to describe in detail the thoracic support locating assembly which provides the same function as the pelvic support locating assembly described herein above. As shown in FIG. 1 the cradle plate 84 is provided with two vertical threaded rod pairs 102 and 104 which correspond to the rod pairs 52 and 54 mounted on the pelvic support 18. These rod pairs lie along the outside edges of the cradle plate so that the upper portion of the cadaver may be placed therebetween. After the cadaver is so positioned a cross bar 106 is fastened to the rod pairs. This cross bar supports a thoracic locater Tee 108 which is provided with cross hairs 110 in a U-shaped cutout at the end of the thoracic locater Tee nearest the pelvic support. These cross hairs 110 may be utilized with a tube 112 which may be fastened upon a screw 114 in order to align the upper portion of the cadaver. This screw may be inserted into the center of the uppermost plate of one of the vertebra. The vertebra used and the procedure employed depend upon the specific requirements of the actual experiment to be performed. Therefore, as with the pelvic locating assembly above, the details of these devices need not be described in detail herein.

It may be convenient however to have parallel rods in the cross hairs correspond to the expected position of the threaded rods, described herein below, which will be inserted into the cadaver. This procedure allows a preliminary radiograph to ascertain the position of the cross hair rods with respect to the threaded rods.

It is now convenient to describe in detail the twisting devices refered to herein above. Threaded rod pairs 52, 54, 102 and 104 each support an extension arm 116 which extends inward toward the center of the table. Each of these extension arms is provided with a pair of alignment holes 118 to be utilized as described below. After the cadaver has been positioned and aligned with respect to the table, each of the extension arms is provided with a drill jig 120 which is secured to the arm through the alignment holes. These drill jigs are utilized to accurately drill a pair of holes in both the thoracic and pelvic regions of the cadaver. Each of these holes extends through the width of the cadaver and matches the corresponding drill jig holes in the other side.

As noted above, the location of the various mechanical attachments made to the cadaver depends primarily upon the details of the particular experiment or examination to be made so that the particular arrangement to be described below is means for illustrative purposes only and may be adjusted as required. The holes drilled in the thoracic region may be conveniently drilled through the central portions of adjacent vertebra. In the pelvic region holes drilled at this same vertical level would encounter a fairly massive bone structure. It is therefore more desirable to drill the pelvic holes a few inches higher, toward the front of the cadaver. This placement of the drill holes is easily accomplished by adjusting the height of the extension arm 118 on the vertical threaded rod pairs.

Figure 7:
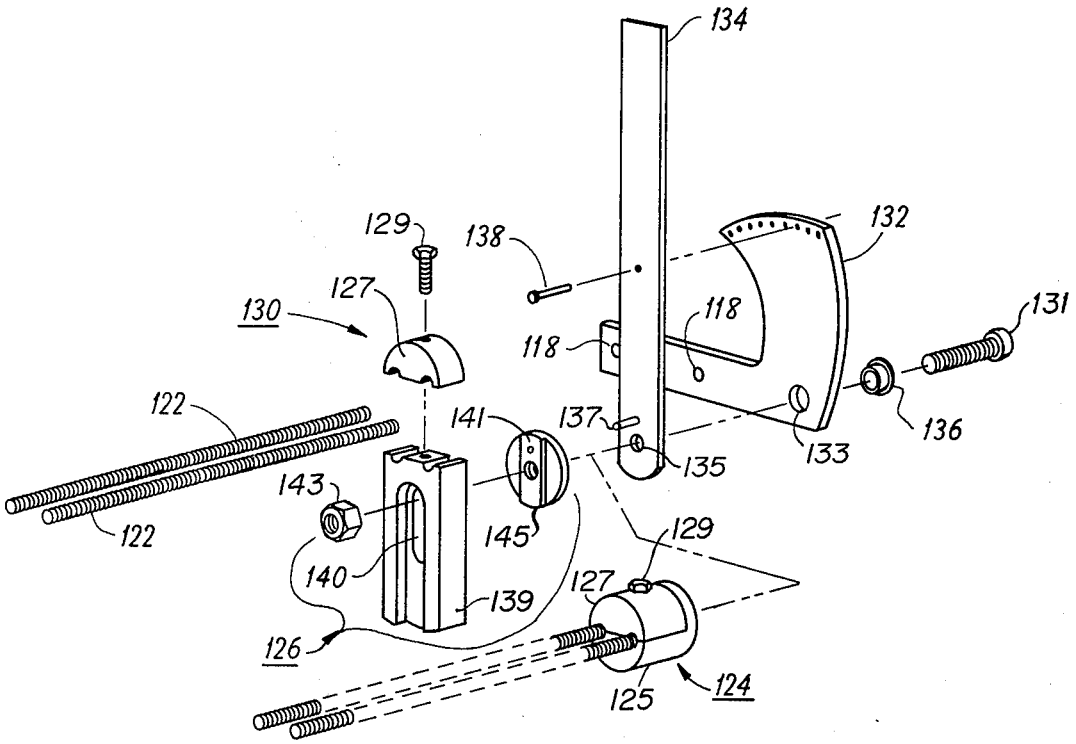
FIG. 7 is an exploded view of the twisting devices of the instant invention including the both pelvic and thoracic threaded rod holders.
Figure 8:
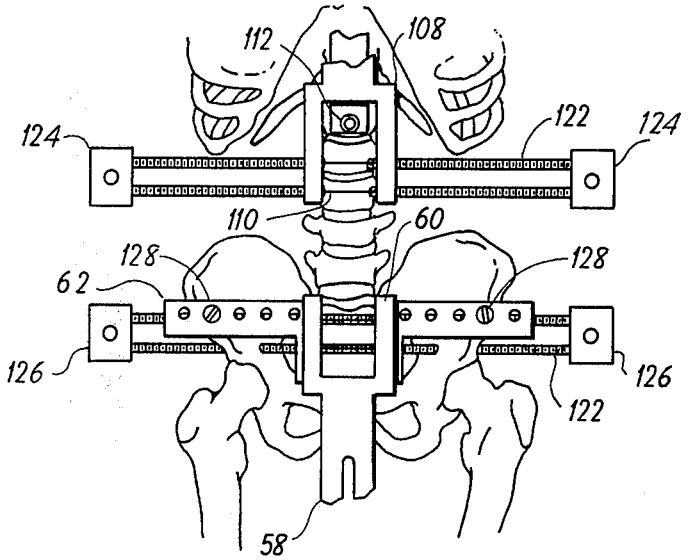
FIG. 8 is a top view of a human skeleton showing the relative positioning of the threaded rods and other devices of the preferred embodiment of the instant invention shown herein.

As shown in FIG. 8, after the holes are drilled, four threaded rods 122 are inserted into the holes. In FIG. 8 the skeleton only of the cadaver is shown for clarity. The ends of the two rods 122 in the pelvic region are secured by two rod holders 124 and the rods in the thoracic region are secured by two other rod holders 126 as shown. These rod holders will be described below in greater detail with reference to FIG. 7.

Also shown in FIG. 8 is the pelvic locator Tee 62 affixed to the iliac crest by means of screws 128. These screws may be inserted through one of a series of holes in Tee 62 depending upon the size of the cadaver. Pelvic support located 58 is shown superimposed upon Tee 62 as would be the case after proper positioning and alignement of the cadaver. Cross hairs 60 line up with cross hairs 66 (which are therefore not visible in FIG. 8) and also with the threaded rods 122.

In much the same manner cross hairs 110 of thoracic support locator 108 line up with the rods 122 in the thoracic region. Since there is no convenient bone structure in the thoracic region to mount a device similar to pelvic locator Tee 62, a screw, not shown, is inserted into a vertebra a fixed distance beyond where the rods are to be positioned. Tube 112, which is mounted to locator 108, is positioned over the screw. Since the distance from tube 112 to cross hairs 110 can be adjusted to be equal to the distance from the screw to be desired position of rod 122, the upper portion of the cadaver may be thereby aligned with the table.

FIG. 7 is an exploded view of one of the four twisting devices 130 referenced above including the rod holders 126 and 124 which are used in the thoracic and pelvic regions respectively. After the holes have been drilled through the cadaver and the drill guides 120 have been removed, a twisting device 130 is affixed to each of the extension arms 116 using alignment holes 118 which correspond to similar alignment holes 118 in sector 132.

Rigidly affixed to lever arm 134 is either the pelvic rod holder 124 or the thoracic rod holder 126, depending of course upon the location of the twisting device. As described above, it may be convenient to drill the holes through the thoracic region which are through the spine. In order not to distort the relationships between the vertebra and discs it is desirable that the rods in the pelvic region be rotated about the same level as the rods in the thoracic region. It is therefore necessary to use holder 126 which can be adjusted along slot 140 to compensate for the difference in the location of the holes without changing the pivot point for lever 134.

Pelvic rod holder 124 includes lower portion 125 and upper portion 127 which are secured together by means of screw 129 to hold twisting rods 122 therebetween. Bolt 131 is mounted through a bearing 136 which fits in opening 133 of sector 132 to allow bolt 131 to rotate freely therein. Bolt 131 also passes through opening 135 in lever arm 134 to secure pelvic rod holder 124 thereto so that rotation of lever arm 134 causes rotation of rod holder 124, and therefore twisting rods 122, about the longitudinal axis of bolt 131. Pin 137 may be provided, affixed to lever arm 134, to fit within an opening in pelvic rod holder 124 to asure that holder 124 rotates with lever arm 134.

Thoracic rod holder 126 includes lower portion 139 and upper portion 127 which are secured together by screw 129 to hold twisting rods 122 therebetween in a manner similar to that described above with reference to pelvic rod holder 124. Thoracic rod holder 126 is mounted to bolt 131 in a different manner from rod holder 124 in order to allow compensation for the difference in the location of the holes drilled in the cadaver as described above. To accomplish this, thoracic rod holder 126 further includes disc 141 affixed to leverarm 134 by bolt 131 and pin 137. Bolt 131 extends through disc 141, and slot 140 in lower portion 139, and is secured thereagainst by means of nut 143. The desired compensation may therefor be provided by unloosening nut 143 and adjusting the position of holder 126. Disc 141 includes raised portion 145 which serves to guide holder 126 and help secure holder 126 to lever arm 134 for rotation therewith.

It is now convenient to describe, in summary fashion, the various functions of the completed unit described above. After the cadaver has been properly aligned with the table and the four twisting rods 122 have been inserted, the radiographic equipment may be moved into place. Individually or in any combination the following manipulations of the cadaver may be made:

1. The pelvic support may be moved with respect to the thoracic support using locking device 28 thereby lengthening or shortening the spine. The distance moved will be indicated on the micrometer position detecting device 30.

2. Both the pelvic and thoracic supports may be moved, while locked together, by adjustment of threaded rod 38 thereby providing a fine adjustment between the position of the cadaver and the external equipment, such as the radiographic apparatus.

3. Both the pelvic and thoracic supports may be moved, while locked together, by chaning the pinning of the pin 40 in the series of holes 34, thereby providing an accurate and repeatable means of indexing of the subject's position with respect to the external equipment.

4. The threaded thoracic twisting rods 122 may be rotated by motion of the corresponding lever arms 134, thereby bending the upper portion of the spine forward or backward.

5. The threaded pelvic rods 122 may be rotated by motion of the corresponding lever arms 134 thereby bending the lower portion of the spine forward or backward.

6. The lateral bending plate 74 may be rotated about pin 76 with respect to the base plate 72 of the thoracic support 16 thereby bending the spine about an axis perpendicular to the table to provide controlled lateral bending motion.

7. The cradle plate 84 may be rotated about axis 88 thereby rotating the spine about its own axis to provide controlled axial rotational motion.

It is important to note that all of the above described manipulations may be performed in three different modes. In the first mode the manipulation to fixed position or amount of motion may be secured by the proper pinning or other locking mechanism. In the second mode the manipulation may be performed on the subject and then the subject may be allowed to stabilize, that is, to resume its most natural configuration in that position subject, of course, to the slight friction present in the low friction assemblies used. In the third mode, instead of allowing the cadaver to assume its natural position, the forces present tending to cause the resumption of the natural position may be measured.

Turning now to the radiographic equipment itself, it must be remembered that as experimental or examinational equipment the configuration of the recording equipment such as the Xray apparatus depends greatly on the information sought. Therefore, as the radiographic apparatus may be quite conventional in configuration, it is only necessary for the purposes of this disclosure to point out that the devices described here allow the placement of a sensitive radiographic plate or other recording mechanism a fixed distance vertically below the exposed portion of the spine free from interference. This plate would obviously be positioned in the space above the plates 42 and 72 and below plates 46 and 84 of the pelvic and thoracic supports respectively. The design disclosed herein is also capable of allowing a second sensitive plate to be positioned at right angles to the above mentioned sensitive plate so that two radiographs or other records may be made simultaneously. A second radiographic source at right angles to the first would be required in this instance.

I claim:

1. A support table for use in supporting, positioning and manipulating a body during examination of the spinal regions of said body by means of radiographic examination equipment and the like, comprising:

a rigid base having an elongate runway system thereon;

a pelvic support for supporting the pelvic regions of the body, said support being slidably mounted on said rigid base for motion along said runway system;

a thoracic support for supporting the thoracic regions of the body so that a portion of the spinal region of said body between said supports is easily accessible for examination purposes, said thoracic support being slidably mounted on said rigid base for independent motion along said runway system in the same manner as said pelvic support;

releasable locking means for securing said thoracic support to said pelvic support to control relative motion therebetween so that said portion of said spinal region may be subjected to axial compression or elongation forces; and indexing means mounted to said base table for moving at least one of said supports so that said spinal region may be accurately and repeatably indexed and positioned along said runway system with respect to a fixed point on said runway system related to said examination equipment.

2. A support table as claimed in claim 1 further comprising:

a rotatable lateral bending plate assembly positioned upon one of said supports for bearing a portion of the weight of said body; and adjustable pivot point means connecting said bending plate assembly to said one of said supports to provide a pivot point for rotation of said lateral bending plate assembly, with respect to said one of said supports, said pivot point being positionable along the spine of said body to adjust for the size of said body so that rotation about said point will provide controllable and lifelike lateral bending motion of said body while exposing said spinal region to said examination equipment.

3. A support table as claimed in claim 1 further comprising:

a rotatable cradle plate assembly positioned above one of said supports having a surface for bearing a portion of the weight of said body, and axial rotation means for providing a first axis of rotation for said cradle plate assembly, with respect to the other of said supports, said axis being positioned above said weight bearing surface to correspond with the approximate anatonical axis of said spine so that rotation of said cradle plate assembly about said first axis will provide controllable and lifelike axial twisting of the spinal region of said body while exposing said spinal region to said examination equipment.

4. A support table as claimed in claim 3, wherein said axial rotation means comprises:

a first pivot point above said weight bearing surface along said first axis of rotation, said first pivot point being positioned at the extreme end of said one of said supports so that said body may be positioned up on said weight bearing surface free of interference from said first pivot point, and second pivot point means beneath said weight bearing surface for providing a phantom pivot point along said first axis, said second pivot point means being disposed toward the center of said weight bearing surface so that said body may be positioned upon said weight bearing surface free of interference from said second pivot point means.

5. A support table as claimed in claim 1, further comprising:

twisting means associated with at least one of said supports for rotating the portion of said body positioned on said support about a second axis perpendicular to said spine at a fixed distance above said support so that rotation about said second axis will provide controllable and lifelike forward bending motion of said body while exposing said spinal region to said examination equipment.

6. A support table as claimed in claim 5, wherein said twisting means comprises:

a pair of threaded rod members for side by side insertion into the body parallel to said second axis of rotation;

end plate means for securing said rod members into fixed relationship with each other; and means for rotating said end plate means about said second axis.

7. A support table as claimed in claim 6, further comprising:

second twisting means associated with the other of said supports for rotating the portion of said body positioned on said other support about a third axis parallel to said second axis so that rotation about said third axis will provide additional forward bending motion of said body while exposing said spinal region to said examination equipment.

8. A support table as claimed in claim 7, wherein said twisting means further includes:

means for adjusting the vertical location of said pair of rod members so that said members may be inserted in any convenient location in the body while retaining the fixed vertical distance of the axis of rotation above the support.

9. A support table as claimed in claim 8, wherein said third axis is located at the same fixed distance above the supports as the second axis.

10. A support table as claimed in claim 9, wherein said second and third axes are positioned above said supports to correspond with the approximate center of said spine.

* * * * *